US005220939A

United States Patent [19]

Hamasaki et al.

[11] Patent Number: 5,220,939

[45] Date of Patent: Jun. 22, 1993

[54] FLOW CONTROL APPARATUS

[75] Inventors: Yoshiaki Hamasaki, Kashiba; Akihiko Shiina, Yamatokooriyama; Kouji Nakayama, Kashihara, all of Japan

[73] Assignee: Koyo Seiko Co., Ltd., Osaka, Japan

[21] Appl. No.: 881,436

[22] Filed: May 11, 1992

[30] Foreign Application Priority Data

May 21, 1991 [JP] Japan ..... 3-146943
Sep. 25, 1991 [JP] Japan ..... 3-086239[U]

[51] Int. Cl.[5] ..... F16K 11/07; G05D 11/00

[52] U.S. Cl. ..... 137/117; 137/501; 251/284

[58] Field of Search ..... 137/504, 117, 115, 110, 137/517; 251/284

[56] References Cited

U.S. PATENT DOCUMENTS 3,170,481 2/1965 Presnell ..... 137/504 X
3,752,182 8/1973 Brand ..... 137/504
3,850,195 11/1974 Olsson ..... 137/504
4,361,166 11/1982 Honaga et al. ..... 137/117
4,549,566 10/1985 Fujiwara et al. ..... 137/117
4,700,733 10/1987 Uchino et al. ..... 137/117
4,768,540 9/1988 Mochizuki et al. ..... 137/117

FOREIGN PATENT DOCUMENTS 127308 5/1989 Japan .
3-550 1/1991 Japan .

*Primary Examiner*—Stephen M. Hepperle
*Attorney, Agent, or Firm*—Darby & Darby

[57] ABSTRACT

A flow control apparatus is disclosed which includes a housing, a cylinder disposed in the housing and a spool disposed in the cylinder while being urged in one direction along the axial direction of the cylinder. The spool slides along the axial direction against the urging force, to adjust the flow quantity of a fluid. A stopper is disposed in the housing for restricting the range of the sliding movement of the spool toward the urging direction. A pair of engaging projections are disposed on the peripheral wall of either the housing and the stopper and are separated from each other by substantially 180 degrees, and an engaging hole disposed in the other of the peripheral wall and the stopper so as to engage at least one of the engaging projections. This at least one projection is engaging with the engaging hole by the urging force acting on the spool, to attach the stopper to the housing.

11 Claims, 11 Drawing Sheets

FLOW CONTROL APPARATUS

BACKGROUND OF THE INVENTION

1. Field of the Invention

This invention relates to a flow control apparatus in which a part of a fluid discharged from a pump is returned to a suction side of the pump by sliding a flow regulating spool in a valve bore, thereby controlling the flow delivered to a destination, and more particularly to a flow control apparatus which reduces inversely the delivering flow in a range of a large quantity of the discharged fluid.

2. Description of the Related Art

In many fluid delivery system, the flow delivered to the destination must be controlled in accordance with requirements of the destination. In such a system, a pump which is a source of the delivered fluid is provided with a flow control apparatus which controls the delivering flow by returning a part of the fluid discharged from the pump to the suction side.

For example, in a hydraulic power steering apparatus in which a hydraulic fluid is delivered to a hydraulic actuator disposed in a steering mechanism and the steering assisting force is obtained by a force generated by the hydraulic actuator, a hydraulic pump which is a generating source of the hydraulic fluid is generally driven by an engine, and the discharging flow from the hydraulic pump is increased as an automobile speed increases. On the other hand, the road reaction force acting on the wheels during the steering operation is great when the automobile stops or runs at a low speed and small when the automobile runs at a high speed. Therefore, a power steering apparatus which is operated by a delivered hydraulic fluid is required to generate a steering assisting force which increases or decreases depending upon whether the automobile speed is low or high. Accordingly, it is required that a hydraulic pump can maintain its delivering flow to a power steering apparatus at a substantially constant level irrespective of the quantity of the discharged fluid and more preferably, in a range of a greater quantity of the discharged fluid in a high speed running of the automobile, reduce inversely the quantity of the fluid delivered to a power steering apparatus. A hydraulic pump is provided with a flow control apparatus for accomplishing such an automatic regulation o f the quantity of the delivered fluid.

In such a flow control apparatus, a supply chamber to which a fluid discharged from a hydraulic pump is supplied and a delivery chamber communicating with the destination are formed in a valve bore of the pump housing, and a throttle section is formed between these chambers. Furthermore, a flow regulating spool is disposed so that its sides respectively face the supply chamber and a pressure chamber in communicating with the delivery chamber. The flow regulating spool is operated by the pressure difference between these two chambers (i.e., by the pressure different across the throttle section). The operation of the flow regulating spool causes a part of a hydraulic fluid supplied to the supply chamber to return to the suction side of the hydraulic pump. In accordance with the operating position of the flow regulating spool, the fluid supplied to the supply chamber is distributed to the delivery chamber and a circulation passage communicating with the suction side. The pressure difference across the throttle section upon which the operating position of the flow regulating spool depends corresponds to the quantity of the fluid passing the throttle section (i.e., the quantity of the fluid delivered to the destination). Hence, the operation of the flow regulating spool causes the quantity of returned fluid to be increased in accordance with the increase of the quantity of the delivered fluid, thereby maintaining the quantity of the delivered fluid at a substantially constant level.

A flow control apparatus has been practically used in which the throttle section is composed of a fixed throttle through which the entirety of the fluid supplied to the supply chamber passes, and a variable throttle varying its area in accordance with the pressure difference across the fixed throttle. Since the flow path resistance of the variable throttle increases with the increase of the quantity of the supplied fluid, this flow control apparatus can decrease the quantity of the delivered fluid inversely as the quantity of the supplied fluid (i.e., the fluid discharging flow of the pump) increases, and hence is widely used as one satisfying the above-mentioned requirements of a power steering apparatus.

A typical example of a flow control apparatus of this kind is disclosed in U.S. Pat. No. 4,361,166. FIG. 1 is an enlarged sectional view illustrating the main portion of this flow control apparatus.

As shown in FIG. 1, this flow control apparatus comprises a discharge passage 10 which is in communication with the discharge side of a hydraulic pump and a circulation passage 11 in communication with the suction side thereof. These passages 10 and 11 are formed in a housing of a hydraulic pump and open while being separated along the axial directon by an adequate distance in a valve bore 1 which is communicated with the destination of a hydraulic pressure through a delivering union 3 threadably fixed to an open end thereof. At the innermost position of the valve bore 1, a flow regulating spool 2 is inwardly fitted so as to be slidable in the axial direction. The flow regulating spool 2 is urged toward the open end (the left side of the figure) by a compressed spring (not shown) interposed between the spool 2 and the bottom face of the valve bore 1, to be pressed against the forward end of the delivering union 3 which is extended so as to close the open end of the discharge passage 10.

An extended portion 30 of the delivering union 3 has a cylindrical internal cavity which is divided by a throttle plate 31 fitted into the cavity into a supply chamber 5 and a delivery chamber 6 which communicates with the destination. The supply chamber 5 is in flow communication with the discharge passage 10 through a fixed throttle 32 which is configured as a hole penetrating the periphery wall of the extended portion 30. The supply and delivery chambers 5 and 6 are placed in communications with each other by a throttle hole **31*a* penetrating the center portion of the throttle plate 31 and also by a plurality of throttle holes 31*b* which are arranged with a uniform space around the hole 31*a***.

The internal pressure of the delivery chamber 6 is led to the back side of the flow regulating spool 2 through a communicating passage 12 which is parallel with the valve bore 1. The flow regulating spool 2 is caused to slide toward the innermost portion of the valve bore 1 against the resilience of the compressed spring by the pressure difference between the supply and delivery chambers 5 and 6 which is generated by the passing of the fluid through the throttle holes **31*a* and 31*b*, thereby increasing the opening area of the circulation passage 11** which opens in the valve bore 1. This causes a part of the fluid supplied into the supply chamber 5 to return to the suction side through the circulation passage 11, with the result that the quantity of the delivered fluid outputted via the delivery chamber 6 is decreased.

In the supply chamber 5, a throttle spool 33 is fitted so as to be coaxially slidable. A coil spring 34 which urges the throttle spool 33 and the throttle plate 31 in opposing directions is interposed between the throttle spool 33 and the throttle plate 31. The throttle spool 33 comprises a fluid passage bore 33*a* which opens at the axial portion in the side of the flow regulating spool 2 and which is branched into a pair of bores slanting radially and outwardly so as to open in the side of the throttle plate 31. The sliding movement of the throttle spool 33 in the urging direction of the coil spring 34 is restrained by a stopper 35 engaged into the inner wall of the extended portion 30 in the side of the flow regulating spool 2. Between the stopper 35 and the throttle spool 33 is, formed an annular chamber which is in communication with the discharge passage 10 through a pressure lead bore 36 which penetrates the periphery wall of the extended portion 30.

The fluid supplied from the discharge passage 10 into the supply chamber 5 through the fixed throttle 32 advances to the front side of the throttle plate 31 via the fluid passage bore 33*a* formed in the throttle spool 33, and is then introduced into the delivery chamber 6 through the throttle holes 31*a* and 31*b* which penetrate the throttle plate 31, and delivered to the predetermined destination. At this time, the throttle spool 33 is moved to slide against the resilience of the coil spring 34 toward the throttle plate 31, by the difference between the internal pressure of the supply chamber 5 and that of the discharge passage 10 which is led via the pressure lead bore 36 into the annular chamber formed between the throttle spool 33 and the stopper 35 (i.e., by the pressure difference generated across the fixed throttle 32), so that the throttle hole 31*a* at the center of the throttle plate 31 is closed by a projection 33*b* formed at the front end of the throttle spool 33. Namely, the throttle holes 31*a* and 31*b* formed in the throttle plate 31 function as a variable throttle which decreases its throttle area in accordance with the increase of the pressure difference generated across the fixed throttle 32 by the supply of the hydraulic fluid into the supply chamber 5. In accordance with the pressure difference generated across the variable throttle by the supply of the introduced fluid into the delivery chamber 6, the flow regulating spool 2 slides as described above, thereby adjusting the quantity of the fluid introduced into the delivery chamber 6, i.e., the quantity of the fluid delivered to the destination.

Therefore, in a hydraulic pump provided with the flow control apparatus, the quantity of the delivered fluid increases proportionally as the rotational speed of the pump increases over a relatively small range. After the flow regulating spool 2 has been caused to begin the sliding movement by the increase of the quantity of the delivered fluid, however, the quantity of the fluid returned to the circulation passage 11 increases in accordance with the increase of the quantity of the fluid supplied form the discharge passage 10, with the result that the quantity of the fluid delivered to the destination is maintained at a substantially constant level irrespective of the increase of the pump rotational speed. When the quantity of the supplied fluid increases further, the throttle spool 33 is caused to begin to slide by the pressure difference generated across the fixed throttle 32. During the period from this time to a time when the throttle hole 31*a* at the center of the throttle plate 31 is closed by the projection 33*b* formed at the front end of the throttle spool 33, the throttle area of the variable throttle which consists of the throttle holes 31*a* and 31*b* decreases, resulting int hat its flow path resistance increases. This causes the increasing rate of the quantity of the returned fluid which is produced by the sliding movement of the flow regulating spool 2, to exceed the increasing rate of the quantity of the supplied fluid, and the quantity of the fluid delivered to the destination is decreased inversely as the rotational speed of the pump increases, whereby the quantity of the delivered fluid varies int he manner shown in FIG. 2. This manner of varying the quantity of the delivered fluid is desirable in a generating source of a hydraulic fluid for a power steering apparatus.

However, a conventional flow control apparatus having such a configuration has a drawback that, since the entire quantity of the fluid introduced into the delivery chamber 6 passes through the fluid passage bore 33*a* formed in the throttle spool 33, a large dynamic pressure acts on the throttle spool 33, and particularly, in a range of a greater quantity of the fluid introduced into the delivery chamber 6, the operation of the throttle spool 33 is unstable, and therefore it is difficult to stably obtain the range of the reduced quantity of the delivered fluid which is shown n FIG. 2. This drawback maybe overcome by enlarging the area of the fluid passage bore 33*a* to reduce the velocity of flow in the fluid passage bore 33*a*. However, the increase of the area of the fluid passage bore 33*a* formed in the throttle spool 33 which is coaxially fitted in the extended portion 30 of the delivering union 3 has a limitation. In order to eliminate the unstable operation of the throttle spool 33 which is caused by the dynamic pressure, it is required to make the bore of the throttle spool 33 large, causing a problem in that the overall size of the flow control apparatus becomes large.

Furthermore, such a conventional flow control apparatus has a complex shape in which the flow path from the supply chamber 5 to the delivery chamber 6 is widened outwardly at the branching portion of the fluid passage bore 33*a* and thereafter contracted toward the throttle hole 31*a* at the center of the throttle plate 31. In such a flow control apparatus, when a hydraulic pump is started in a cold district, for example, the flow of a high viscous fluid is impeded, with the result that a very high surge pressure is generated. This may cause the hydraulic pump at the upper stream and the piping system at the lower stream from the delivering union 3 to the destination to be damaged. Moreover, such a flow control apparatus suffers from the defect that the high surge pressure generates a harsh noise (gargle sound) which prolongs for a long period of time.

SUMMARY OF THE INVENTION

It is an object of the invention to provide a flow control apparatus which can eliminate the unstable operation of a throttle spool performing the operation of opening and closing a variable throttle, so that a desired characteristic can be surely obtained.

It is another object of the invention to provide a flow control apparatus in which the generation of a surge pressure at the time of starting a pump is suppressed by simplifying the construction of the flow path, whereby the pump and the piping system can be prevented from being damaged and a harsh noise from being generated.

It is a further object of the invention to provide a flow control apparatus which has a reduced number of parts and can be easily assembled, thereby enabling the assembly process to be standardized.

A flow control apparatus according to the invention returns a part of a fluid discharged from a pump to the suction side of the pump by sliding a flow regulating spool (first spool) in a valve bore, and reduces inversely the flow quantity of the delivered fluid in a range of a large discharge quantity of the pump. In the flow control apparatus, a throttle housing is disposed between the flow regulating spool at the innermost portion of the valve bore and a delivering union to form a fixed throttle across which a pressure difference is generated by passage of the fluid supplied from a discharge passage. A fluid passage bore (first bore) and cylinder bore (second bore) which are in communication with a delivery chamber through a respective throttle hole are formed in parallel inside the throttle housing. A variable throttle is formed by the throttle holes one of which is opened and closed by a throttle spool (second spool) sliding in accordance with the pressure difference across the fixed throttle and the other of which has a predetermined area. The flow regulating spool is caused to slide by a pressure difference generated across the variable throttle and by the passage of the fluid delivered to the delivery chamber, thereby distributing the fluid supplied from the discharge passage to a circulation passage and the delivery chamber.

The fluid which has been supplied from the discharge passage and has passed the fixed throttle is divided to enter into the fluid passage bore and also into the cylinder bore, and then introduced into the delivery chamber through the respective throttle hole. At this time, only the throttle hole at the side of the cylinder bore is opened or closed by the throttle spool fitted into the cylinder bore. This throttle hole and the throttle hole and the side of the fluid passage bore constitutes the variable throttle which varies its area in accordance with the pressure difference across the fixed throttle. That is, the throttle spool is subjected to the dynamic pressure which is caused not by the entirety of the supplied fluid but by a part of the supplied fluid which flows into the cylinder bore. This dynamic pressure causes the throttle spool to have little change of unstable operation. The flow paths connected to the delivery chamber respectively through the cylinder bore and the fluid passage bore can be constructed in a linear structure, whereby the generation of a surge pressure owing to the impedance of flow is suppressed.

The throttle spool is urged by a coil spring toward the flow regulating spool, and a stopper is disposed which restricts the range of the sliding movement of the throttle spool toward the urging direction. An engaging hole having a linear guide section and a folded blind hole section which is connected to the guide section is formed on the peripheral wall of the throttle housing (or the stopper). On the other hand, an engaging projection which is engaged with the folded blind hole section through the guide section is disposed on the peripheral surface of the stopper (or the throttle housing). The stopper is pressed into the throttle housing against the urging force acting on the throttle spool, and then rotated in the circumferential direction, whereby the engaging projection is caused to be engaged with the engaging hole (folded blind hole section) by the urging force acting on the throttle spool and kept held as it is to be prevented from slipping off.

The above and further objects and features of the invention will more fully be apparent from the following detailed description with accompanying drawings.

BRIEF DESCRIPTION OF THE DRAWINGS

FIG. 10(*b*) is a plan view of a stopper of the second embodiment;

FIG. 10(*c*) is a side elevation view of the stopper of the second embodiment.

DESCRIPTION OF THE PREFERRED EMBODIMENTS

The invention will be described with reference to the drawings illustrating its embodiments.

First Embodiment

Figure 3:
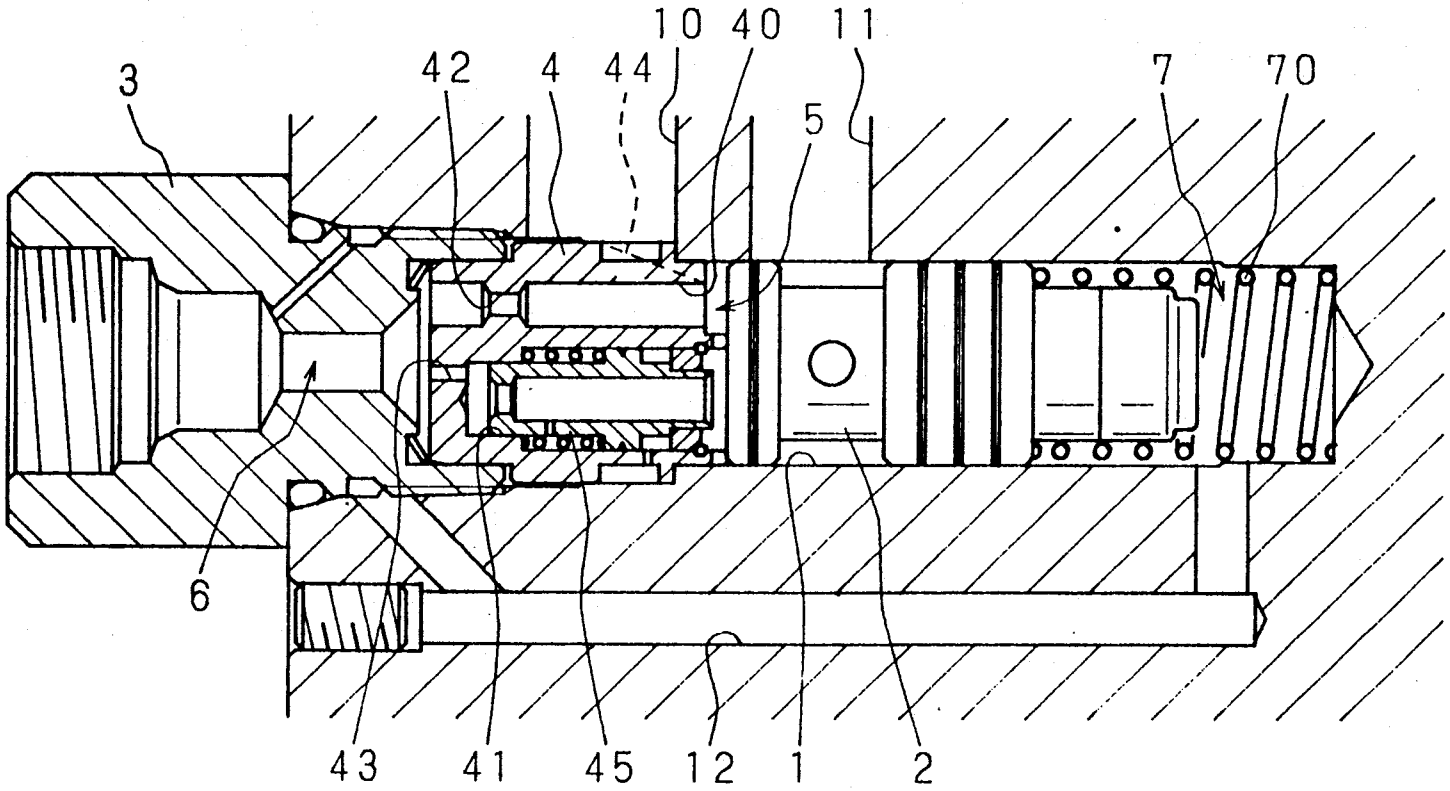
FIG. 3 is a longitudinal section view of a first embodiment of the flow control apparatus of the invention which is in the non-operating state.
Figure 4:
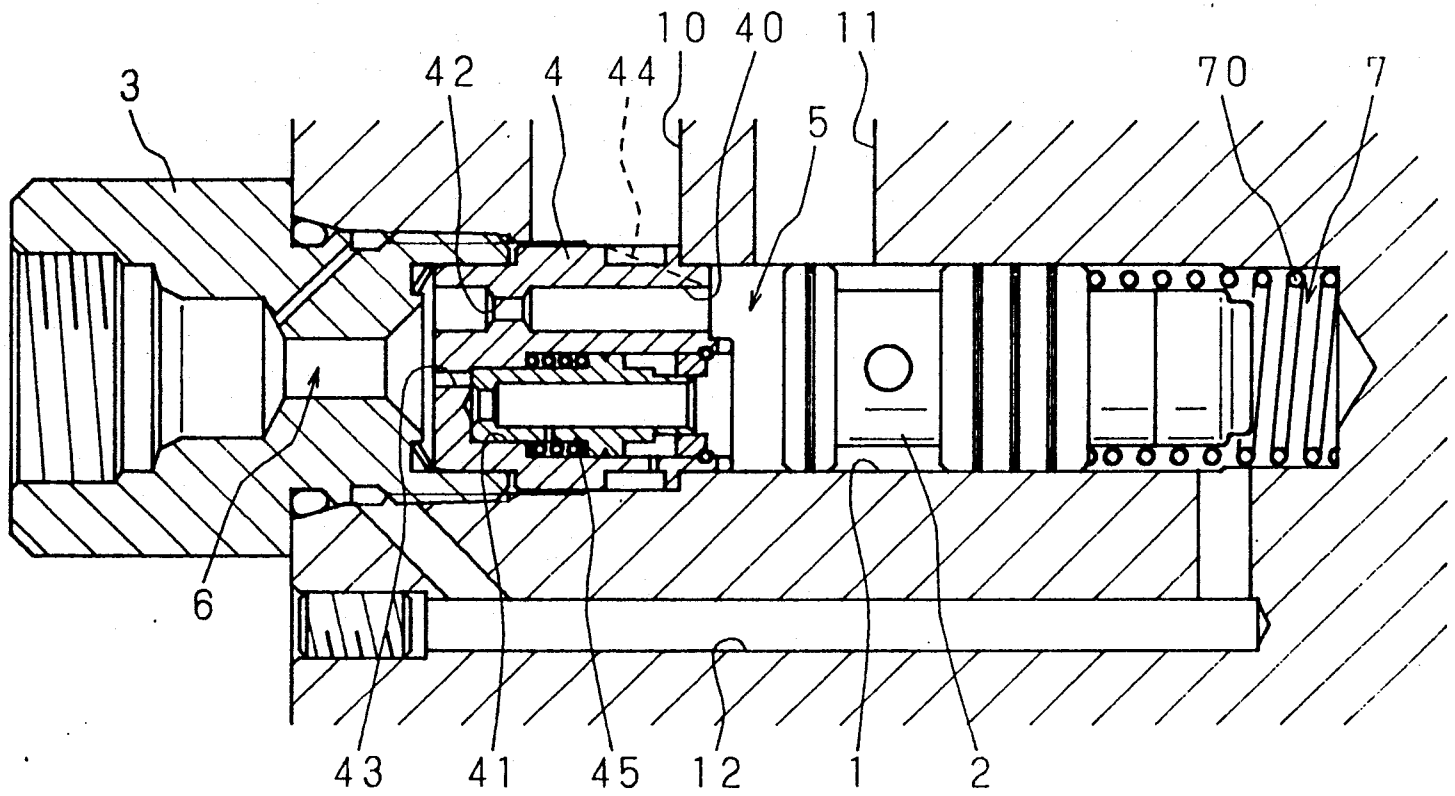
FIG. 4 is a longitudinal section view of the first embodiment of the flow control apparatus of the invention which is in the operating state.

FIGS. 3 and 4 are longitudinal sectional views of a first embodiment of the flow control apparatus of the invention. FIG. 3 illustrates its non-operating state, and FIG. 4 its operating state.

In the figures, 1 designates a valve bore which has a circular section and is formed with a suitable depth in the housing of a hydraulic pump. At the midway of the valve bore 1, a discharge passage 10 which communicates with the discharge side of the hydraulic pump and a circulation passage 11 which is in communication with the suction side thereof are opened with separated by a suitable distance in the axial direction. The opening and innermost sides of the valve bore 1 are in flow communication with each other through passage 12 which is formed in parallel with the valve bore 1.

At the innermost position of the valve bore 1, a flow regulating spool 2 is inwardly fitted so as to be slidable in the axial direction, and a delivering union 3 is threadably fixed to the opening of the valve bore 1. A throttle housing 4 is disposed between the flow regulating spool 2 and the delivering union 3. A supply chamber 5 into which a fluid supplied from the discharge passage 10 is introduced is formed between the throttle hosing 4 and the flow regulating spool 2, a delivery chamber 6 which communicates with a destination (not shown) is formed in the delivering union 3, and a pressure chamber 7 is formed at the innermost portion of the flow regulating spool 2. The pressure chamber 7 is in communication with the delivery chamber 6 through the communicating passage 12.

Figure 5:
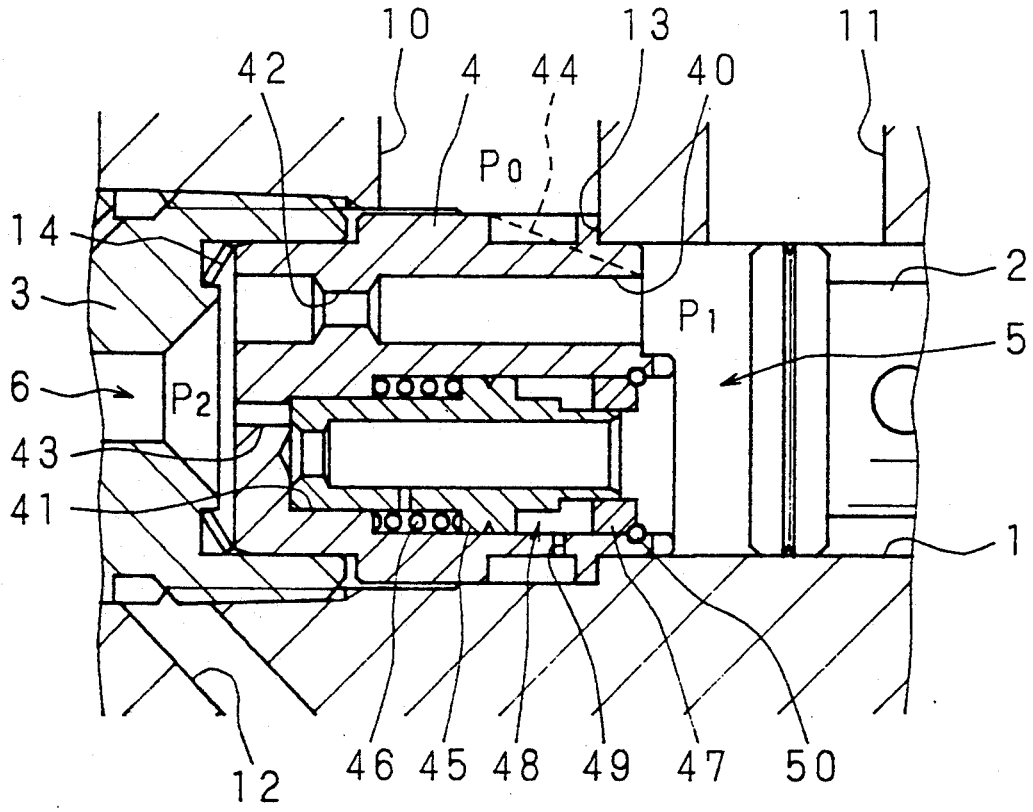
FIG. 5 is an enlarged sectional view of the first embodiment.
Figure 6:
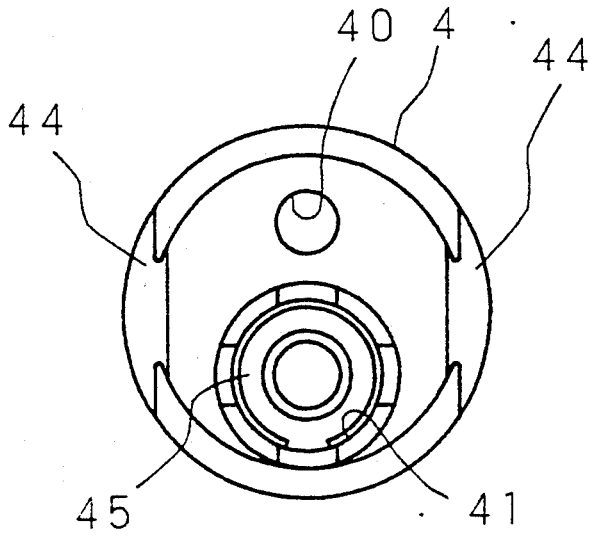
FIG. 6 is a front view of a throttle housing of the first embodiment.

FIG. 5 is an enlarged sectional view illustrating the vicinity of the throttle housing 4, and FIG. 6 is a front view of the throttle housing 4 which is seen from the flow regulating spool 2, i.e., from the innermost side of the valve bore 1. As shown in FIG. 5, the throttle hosing 4 is inserted into the valve bore 1 so as to abut a step portion 13 formed on the inner wall of the valve bore 1, and is fixedly sandwiched through a disk spring 14 between the step portion 13 and the inner end face of the delivering union 3 which is threadably fixed to the open end of the valve bore 1. The throttle hosing 4 faces the end of the discharge passage 10 which opens in the valve bore 1, so as to constitute a fixed throttle 44 as described later. In side the throttle housing 4, a fluid passage bore 40 and a cylinder bore 41 are juxtaposed so that their axes are parallel to the axis of the throttle hosing 4. The bores 40 and 41 respectively have a depth of a predetermined value from inner end face of the throttle housing 4, and are in communication with the supply chamber 5 through their respective open ends, and with the delivery chamber 6 in the delivering union 3 respectively through throttle holes 42 and 43 which are formed at their bottoms.

As shown in FIG. 6, a portion of the innermost side of the throttle housing 4 is cut away in such a manner that the cut away portion slants radially and inwardly from the outer surface toward the inner end. The end of the discharge passage 10 which opens in the valve bore 1 is in communication with the supply chamber 5 through a throttle passage (a fixed throttle 44) which is formed between the cut away portion and the step portion 13. The pressure fluid supplied from the discharge passage 10 flows at first into the supply chamber 5 through the fixed throttle 44, and is then distributed to the fluid passage bore 40 and cylinder bore 41 which open in the supply chamber 5, and introduced into the delivery chamber 6 through the throttle hole 42 connected to the fluid passage bore 40 and the throttle hole 43 connected to the cylinder bore 41.

A cylindrical throttle spool 45 is fitted slidably and coaxially in the cylinder bore 41 so that the fluid introduced into the cylinder bore 41 reaches the throttle hole 43 through the inner cave of the throttle spool 45. The throttle spool 45 is urged toward the flow regulating spool 2 by a coil spring 46 interposed between the throttle spool 45 and the innermost side of the cylinder bore 41. A stopper 47 which restricts the sliding movement of the throttle spool 45 in the urging direction is engaged to the vicinity of the open end of the cylinder bore 41, by a circular clip 50 fitted to the end portion of the throttle housing 4.

Between the stopper 47 and the throttle spool 45, formed is an annular chamber 48 to which the internal pressure of the discharge passage 10 is led through a pressure-lead hole 49 penetrating the periphery wall of the throttle housing 4. The internal pressure of the annular chamber 48 presses the throttle spool 45 in the direction opposite to the urging direction of the coil spring 46, i.e., toward the bottom of the cylinder bore 41. The sliding movement of the throttle spool 45 in the housing direction causes the throttle hole 43 formed eccentrically at the bottom of the cylinder bore 41 to be closed.

On the other hand, the flow regulating spool 2 inserted into the innermost side of the valve bore 1 is abutted to the edge of the open end of the cylinder bore 41 by the resilience of a spring 70 interposed between the throttle spool 2 and the bottom of the valve bore 1, so that the flow regulating spool 2 is placed at the initial position shown in FIG. 3. When both end faces of the flow regulating spool 2 respectively receive the internal pressures of the supply chamber 5 and pressure chamber 7, the flow regulating spool 2 slides rightward in the figure against the resilience of the spring 70. The internal pressure of the pressure chamber 7 is kept substantially equal to that of the delivery chamber 6 which is communicates with the pressure chamber 7 through the communicating passage 12. The sliding movement of the flow regulating spool 2 is caused by the pressure difference between the supply chamber 5 and the pressure chamber 7, so that the circulation passage 11 opens in the supply chamber 5 as shown in FIGS. 4 and 5. Accordingly, a quantity of the pressure fluid which corresponds to the sliding distance of the flow regulating spool 2 is returned to the suction side of the hydraulic pump through the circulation passage 11 without being introduced into the supply chamber 5.

The operation of the thus configured first embodiment will be described. The fluid discharged from the hydraulic pump flows from the discharge passage 10 into the supply chamber 5 through the fixed throttle 44. Then, a part of the discharged fluid is introduced into the delivery chamber 6 through the throttle hole 42 connected to the fluid passage bore 40 and the throttle hole 43 connected to the cylinder bore 41, and then supplied to the destination connected to the delivery chamber 6 via the delivering union 3. The remaining part of the discharged fluid is introduced into the circulation passage 11 to be returned to the suction side of the hydraulic pump. In this case, the ratios of the quantity of the supplied fluid and that of the returned fluid to the entire quantity of the fluid discharged into the supply chamber 5 are determined by the position at which the flow regulating spool 2 is placed as a result of its sliding movement.

When the internal pressure of the discharge passage 10 is $P_0$, as shown in FIG. 5, the internal pressure of the supply chamber 5, fluid passage bore 40 and cylinder bore 41 is $P_1$. $P_1$ is lower than $P_0$ because of the pressure drop owing to the flow passing through the fixed throttle 44. The internal pressure of the delivery chamber 6 is $P_2$ which is lower than $P_1$ because the pressure drop owing to the flow passing through the throttle holes 42 and 43. Therefore, the flow regulating spool 2 increases its sliding distance from the initial position as the pressure difference $(P_1-P_2)$ between the supply and delivery chambers 5 and 6 increases. The pressure difference $(P_1-P_2)$ is generated by the passage of the pressure fluid (which is delivered through the delivery chamber 6) through the throttle holes 42 and 43.

In this case, while the passage area of the throttle hole 42 at the fluid passage bore 40 is constant, the throttle hole 43 at the cylinder bore 41 is opened or closed by the sliding movement of the throttle spool 45 in the cylinder bore 41. Namely, the throttle holes 42 and 43 constitute a variable throttle which varies its throttle area in accordance with the sliding movement of the throttle spool 45. On the throttle spool 45, the internal pressure $P_0$ of the discharge passage 10 which is led into the annular chamber 48 through the pressure-lead hole 49 acts leftward in the figure, and also the resilience of the coil spring 46 and the internal pressure $P_1$ of the cylinder bore 41 which is kept substantially equal to that of the supply chamber 5 act rightward. When the pressure difference $(P_0-P_1)$ which is generated across the fixed throttle 44 by the passage of the part of the fluid discharged from the discharge passage 10 exceeds the resilience force of the coil spring 46, the throttle spool 45 begins to slide. In accordance with the increase of the sliding distance, the throttle hole 43 is closed, thereby decreasing the passage area of the variable throttle consisting of the throttle hole 43 and the throttle hole 42 at the fluid passage bore 40. It is so designed that this sliding movement of the throttle spool 45 is started after the flow regulating spool 2 has begun t slide and the area of the circulation passage 11 which opens in the valve bore 1 has reached a predetermined value. Until the throttle spool 45 begins to slide, therefore, the throttle area of the variable throttle is kept constant.

Accordingly, during a period in which the hydraulic pump discharges the fluid of a small quantity and which continues until the end of the circulation passage 11 is opened by the sliding movement of the flow regulating spool 2, the entire part of the fluid supplied into the throttle housing 4 is introduced into the delivery chamber 6 through the throttle hole 42 at the fluid passage bore 40 and also the throttle hole 43 at the cylinder bore 41 which is at the full open state, and the quantity of the fluid supplied form the delivery chamber 6 increases proportionally as the revolution speed of the hydraulic pump disposed at the upper stream of the discharge passage 10 increases.

Then, during a period in which the pressure difference $(P_1-P_2)$ increases with the increase of the quantity of the delivered fluid and which starts when the flow regulating spool 2 begins to slide to open the circulation passage 11 and continues until the throttle spool 45 begins to slide, the throttle area of the variable throttle which generates this pressure difference is kept constant. Therefore, since the sliding distance of the flow regulating spool 2 increases proportionally as the quantity of the fluid delivered from the delivery chamber 6 increases and the opening area of the circulation passage 11 increases correspondingly, the increment of the supplied fluid is offset by that of the returned fluid, whereby the quantity of the fluid delivered from the delivery chamber 6 is kept substantially constant.

During a period in which the quantity of the supplied fluid increases further and the throttle spool 45 is caused to slide by the pressure difference $(P_0-P_1)$ generated across the fixed throttle 44 and which continues until the throttle hole 43 is completely closed as shown in FIGS. 4 and 5, the passage area of the variable throttle consisting of the throttle hole 43 and the throttle hole 42 at the fluid passage bore 40 decreases as the sliding distance of the throttle spool 45 increases. When the increasing rate of the pressure difference $(P_1-P_2)$ with respect to the increase of the quantity of the introduced fluid to the delivery chamber 6 becomes greater as the quantity of the fluid passing through the fixed throttle 44 (i.e., the supplied fluid) increases, and the increasing rate of the sliding movement of the flow regulating spool 2 which varies in accordance with the pressure difference $(P_1-P_2)$ exceeds that of the supplied fluid, the quantity of the fluid delivered to the destination through the delivery chamber 6 decreases inversely as the quantity of the fluid supplied to the throttle housing 4 (i.e., the rotational speed of the hydraulic pump) increases.

Figure 1:
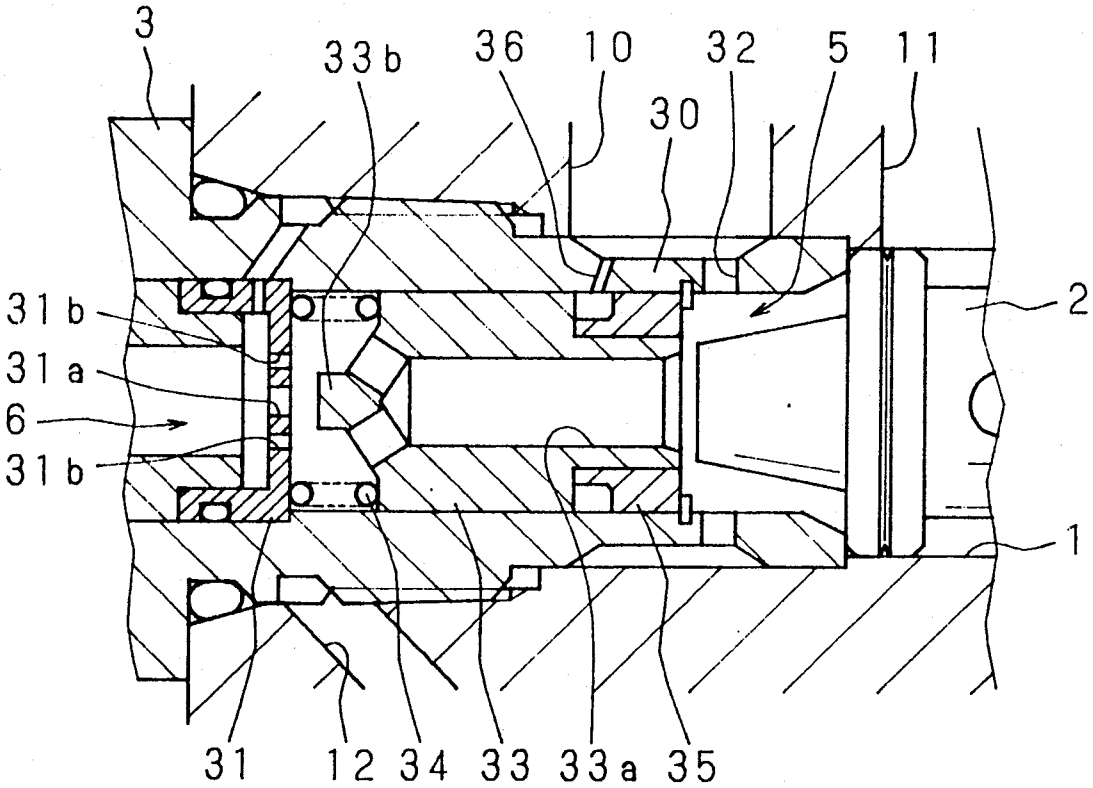
Fig. 1 Prior Art
FIG. 1 is an enlarged sectional view illustrating characteristic portions of a conventional prior art flow control apparatus.
Figure 2:
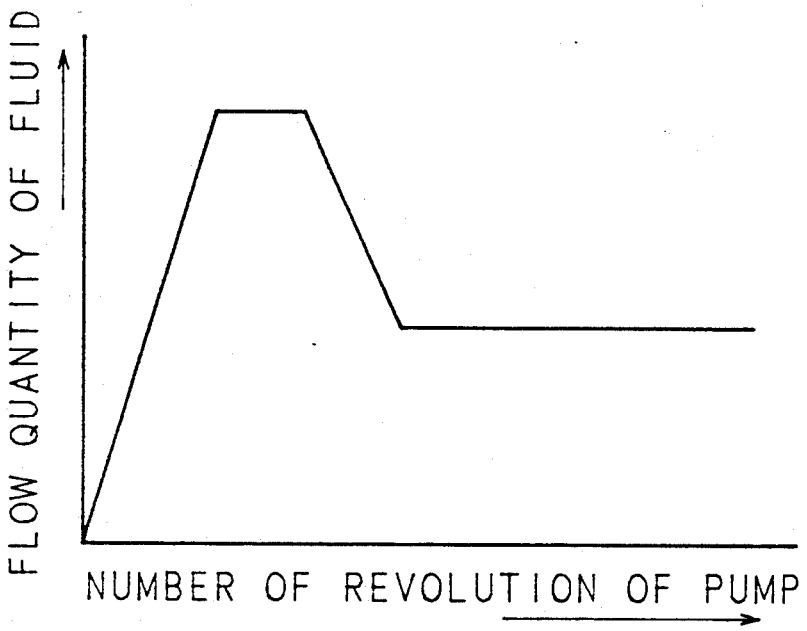
FIG. 2 is a graph showing the characteristic in delivering a hydraulic fluid which is obtained by the operation of a flow control apparatus.

As a result of the above-described operation, the quantity of the fluid delivered to the destination through the delivery chamber 6 varies as follows: in a range where the rotational speed of the hydraulic pump is small, it increases proportionally with the increase of the speed of revolution; in a range where the rotational speed of the hydraulic pump is medium, it is kept constant irrespective of the increase of the speed of revolution; and in a range where the rotational speed of the hydraulic pump is large, it decreases proportionally with the increase of the speed of revolution, with the result that the characteristic in delivering the fluid shown in FIG. 2 is obtained. As described above, such a characteristic is desirable for a system of delivering a hydraulic fluid to a power steering apparatus.

In the above-described operation, a part of the entire quantity of the fluid delivered through the delivery chamber 6 passes through the cylinder bore 41 accommodating the throttle spool 45. Therefore, the dynamic pressure of the passing fluid causes the throttle spool 45 to have little chance of unstable operation and the throttle hole 43 to be surely opened closed, resulting in that the range of the reduced quantity of the delivered fluid which is shown in FIG. 2 can be stably obtained.

On the other hand, in the above-described operation, the pressure fluid flows along the fluid passage bore 40 and cylinder bore 41 which are linearly structured. Accordingly, even when a high viscous fluid is supplied in a case of starting a hydraulic pump in a cold district, for example, the flow of the fluid is not impeded so that the generation of a surge pressure caused by the impedance of flow is suppressed. This can prevent the hydraulic pump at the upstream side and the piping system from the delivering union 3 to the destination from being damaged, and a harsh noise from being generated.

Second Embodiment

In the above-described first embodiment, the stopper 47 is fixed by the circular clip 50 fitted to the throttle housing 4. Alternatively, the stopper 47 may be fixed by a pin which crosses the cylinder bore 41. However, the configuration in which the stopper 47 is fixed by the circular clip 50 or pin requires the operation of fitting the circular clip 50 or inserting the pin. This causes problems in that the configuration is difficult to assemble and that a skilled person is necessary to effectively and accurately perform this operation, and this configuration remains to be improved. An example of a flow control apparatus which can solve these problems, which has a reduced number of parts and which can be easily assembled so as to standardize the assembly process is described below as the second embodiment.

Figure 7:
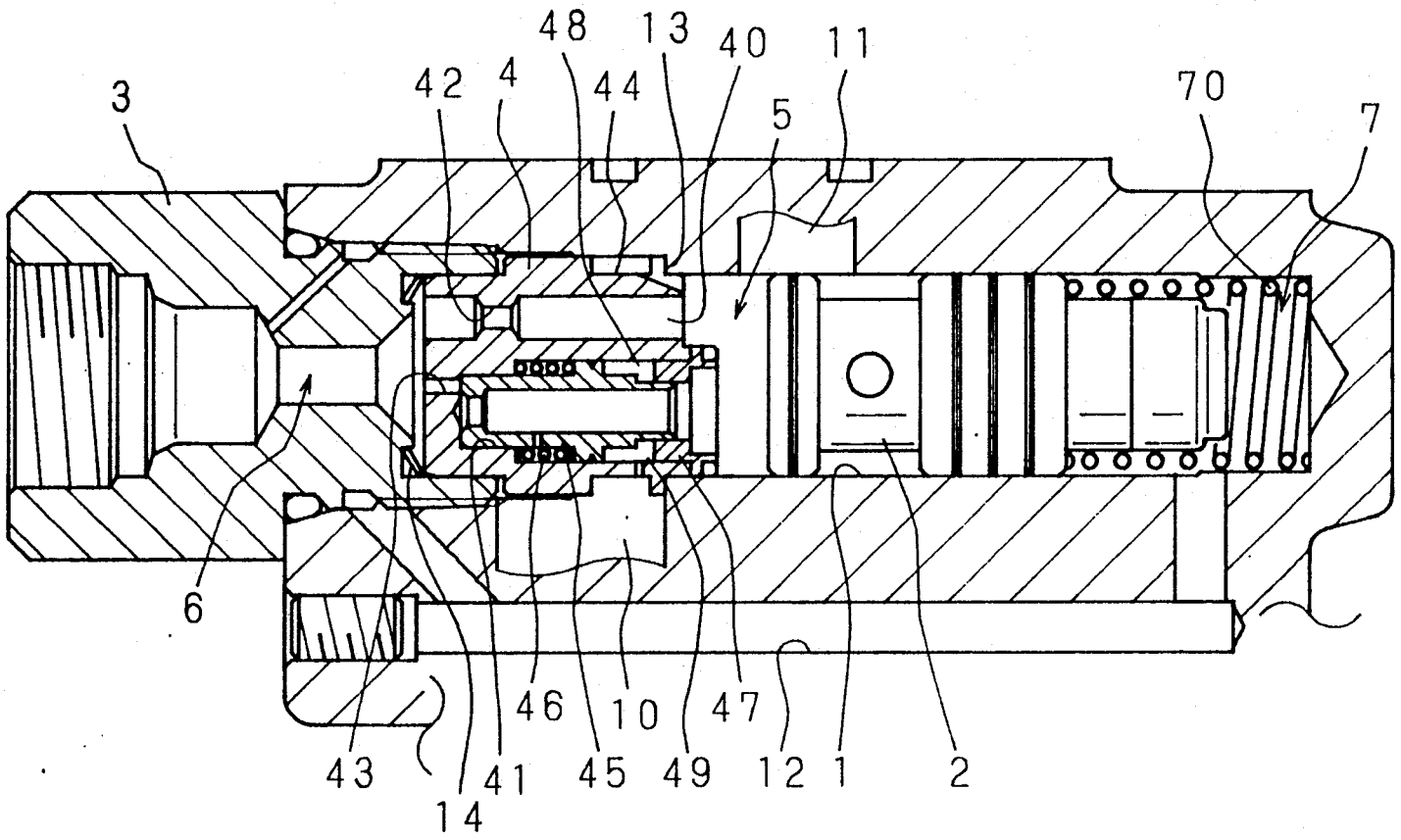
FIG. 7 is a longitudinal section view of a second embodiment of the flow control apparatus of the invention.
Figure 8:
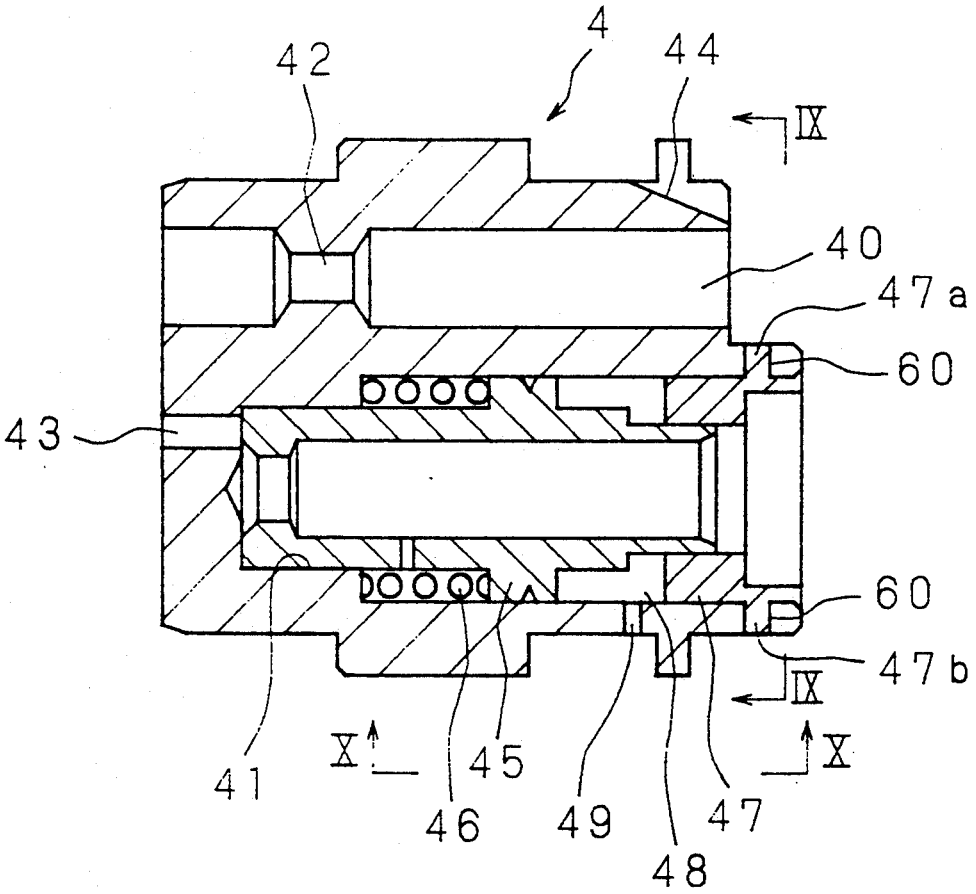
FIG. 8 is an enlarged sectional view of the second embodiment.
Figure 9:
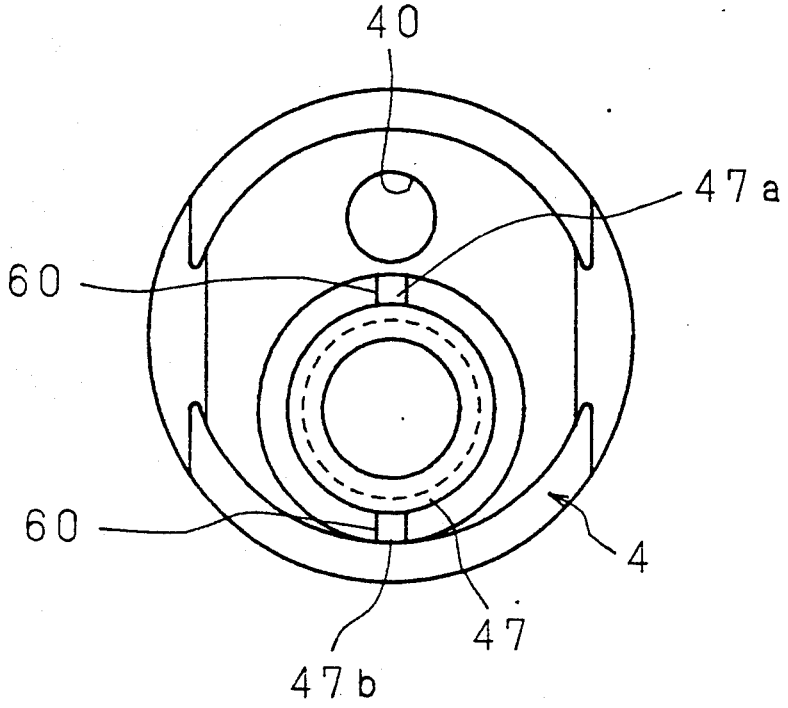
FIG. 9 is a front view seen from line IX—IX of FIG. 8.

FIG. 7 is a longitudinal sectional view illustrating the second embodiment in the operating state, and FIG. 8 is an enlarged sectional view of the vicinity the throttle housing 4. In FIGS. 7 and 8, the same components as those in the first embodiment are designated by the same reference numerals, and their descriptions are omitted. In the second embodiment, the fixing of the stopper 47 is performed in a manner different than that in the first embodiment and namely by fitting the stopper 47 into the throttle housing 4 as described below. FIG. 9 is a front view seen from line IX—IX of FIG. 8, FIG. 10(*a*) is a front view seen from line X—X of FIG.

Figure 10A:
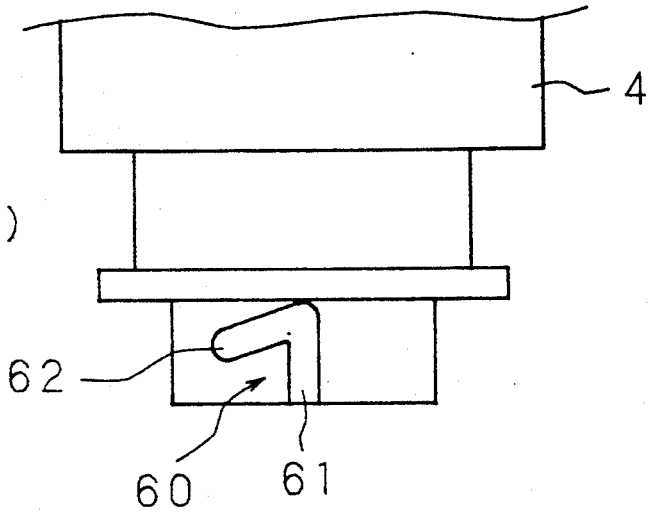
FIG. 10(*a*) is a front view seen from line X—X of FIG. 8.
Figure 10B:
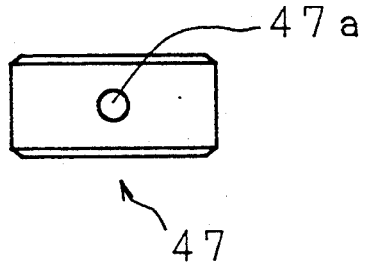
Figure 10C:
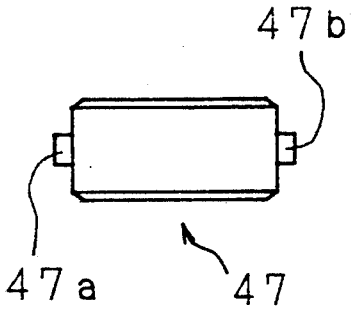

8, FIG. 10(*b*) is an enlarged plan view of the stopper 47, and FIG. 10(*c*) is an enlarged side elevation view of the stopper 47.

As shown in FIGS. 10(*b*) and 10(*c*), the stopper 47 is formed into a short cylinder having an outer diameter which is substantially equal to the inner diameter of the inner end portion of the throttle housing 4. The inner diameter of the stopper 47 at one end portion is smaller than that at the other end portion. On the outer surface, two engaging projections 47*a* and 47*b* are formed which are separated from each other by about 180 degrees along the circumferential direction. On the other hand, on the peripheral wall in the inner end portion of the throttle housing 4 into which the stopper 47 is to be fitted, are formed two engaging holes 60 which are separated from each other by about 180 degrees along the circumferential direction. Each of the engaging holes 60 has a guide section 61 which linearly elongates toward the outer end portion in parallel with the axis of the throttle housing 4, and a folded blind hole 62 which is bent from the end of the guide section 61 by somewhat more than 90 degrees and in a direction substantially same as the circumferential direction.

The two engaging projection 47*a* and 47*b* of the stopper 47 which are respectively formed at the two positions in the circumferential direction are forcibly inserted against the expansion pressure force of the coil spring 46 into the guide sections 61 of the engaging holes 60 until they reach the innermost end of the guide sections 61. Thereafter, the stopper 47 is rotated in the cylinder bore 41 about its axis, and the two engaging projections 47*a* and 47*b* guided into the folded blind holes 62 of the engaging holes 60, and then returned to enter the folded blind holes 62 by the expansion pressure force of the coil spring 46, thereby preventing the stopper 47 from slipping off.

An example of the procedure of assembling the throttle housing 4 in the second embodiment will be described at first, the coil spring embodiment will be described. At of the throttle spool 45, and, while the stopper 47 is fitted on one end portion of the throttle spool 45, the other end portion of the throttle spool 45 is fitted into the cylinder bore 41 of the throttle housing 4. Thereafter, the two engaging projections 47*a* and 47*b* of the stopper 47 are made opposed to the engaging holes 60 of the throttle housing 4, and forcibly inserted against the expansion pressure force of the coil spring 46 into the innermost ends of the guide sections 61, and then the stopper 47 is rotated about is axis. This causes the two engaging projections 47*a* and 47*b* of the stopper 47 to be guided into the folded blind holes 62, and when releasing the stopper 47 from the pressing force they are pressed into the folded blind holes 62 by the expansion pressure force of the coil spring 46, so that the stopper 47 engages with the throttle housing 4. The thus assembled throttle housing 4 and the disk spring 14 are fitted into the forward end portion of the delivering union 3 which in turn is attached to the housing of the hydraulic pump.

The operation of the flow regulating spool 2, that of the throttle spool 45, and the flow operation of the hydraulic fluid which is based on the operations of the spools 2 and 45 in the second embodiment are the same as those in the first embodiment, and therefore their descriptions are omitted.

As described above, in the second embodiment, unlike the first embodiment, the stopper 47 can be easily fixed without using a circular clip. According to the second embodiment, hence, the number of pats can be reduced, and the assembly process can be simplified and standardized so that, even when persons of different skills are engaged in the assembly process, there appears no personal error in assembly efficiency and assembly accuracy.

In the above-described embodiment, the stopper 47 is provided with the two engaging projections 47*a* and 47*b*, and the throttle housing 4 with the engaging holes 60. In contrast to this, the stopper 47 may be provided with two engaging holes each consisting of a guide section and a folded blind hole, and the throttle housing 4 with two engaging projections. This alternative configuration can achieve the same effects as the above-described embodiment. Although the configuration having two engaging projections and two engaging holes has been described, the number of these components is not restricted to two.

Other embodiments

Figure 11:
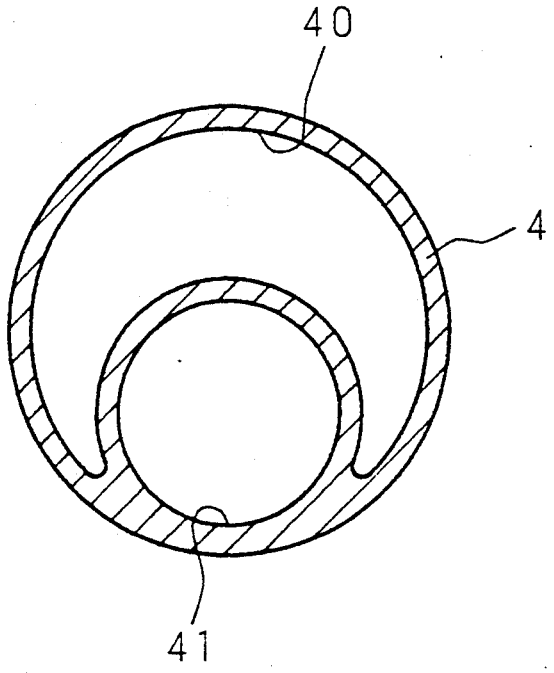
FIG. 11 is a cross sectional view illustrating another example of forming a fluid passage bore and cylinder bore of a throttle housing.

It is sufficient for the fluid passage bore 40 to function as a fluid passage for hydraulic fluid. As shown in the sectional view of FIG. 11, therefore, the fluid passage bore 40 may be formed as follows: at first, the position of forming the cylinder bore 41 having a circular section is determined in the axial section of the throttle housing 4, and the fluid passage bore 40 is formed over a substantially entire portion of the remaining portion. This ensures that a passage area as large as possible can be obtained in the restricted axial section of the throttle housing 4, i.e., the restricted axial section inside the valve bore 1, and therefore on the throttle spool 45, in preventing the surge acting on the throttle spool 45, in preventing the surge pressure caused by the impedance of flow from occurring, and in miniaturization of the entire size of the flow control apparatus.

The disk spring 14 interposed between the throttle housing 4 and the delivering union 3 performs the function of surely putting the throttle housing 4 into the sandwiched state by the use of its resilience, and may be replaced with another elastic body. In a case that an O ring is used as this elastic body, an additional advantage can be achieved in that the leakage path to the delivery chamber 6 via the fitting portion of the throttle housing 4 in the delivering union 3 is interrupted by the sealing effect of the O ring, thereby reducing the internal leakage.

Embodiments in which the flow control apparatus of the invention is applied to a hydraulic pump functioning as a generating source of the hydraulic fluid for a power steering apparatus have been described above. The application of the flow control apparatus of the invention is not limited to this, and it is obvious to those skilled in the art that the flow control apparatus of the invention can be applied to all kinds of fluid delivery systems.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A flow control apparatus comprising:

a valve with a bore having along its length a discharge passage in communication with a discharge side of a pump, and a circulation passage in communication with a suction side of said pump, said discharge passage and circulation passage being separated from each other;

a delivering union threadably fixed to an open end of said valve bore;

a delivery chamber formed in said delivering union and communicating with a predetermined destination;

a fixed throttle formed in said valve bore, a pressure difference being generated across said fixed throttle by passing a fluid introduced from aid discharge passage through said fixed throttle;

a variable throttle formed in said valve bore, said variable throttle changing the throttle area in accordance with the pressure difference generated across said fixed throttle, a pressure difference being generated across the front and rear portions of said variable throttle by passing a fluid to be delivered to said delivery chamber through said variable throttle;

a first spool which slides in said valve bore in accordance with the pressure difference generated across said variable throttle, to control the opening of an open end of said circulation passage to distribute the fluid introduced from said discharge passage to said circulation passage and said delivery chamber;

a throttle housings formed in said valve bore and between said first spool and said delivering union, said throttle housing forming said fixed throttle at a location facing an open end of said discharge passage;

first and second bores which are formed in said valve bore and in parallel, the axes of said first and second bores elongating parallel with the axis of said valve bore, said first and second bores communicating with said delivery chamber through a respectively throttle hole to lead a fluid introduced through said fixed throttle to said delivery chamber; and a second spool which receives the pressure difference generated across said fixed throttle to slide in said second bore, said variable throttle formed by the throttle hole of said second bore which is opened and closed by the sliding movement of said second spool, and the throttle hole of said first bore which has a predetermined area.

2. A flow control apparatus according to claim 1, further comprising:

a coil spring interposed between said second spool and said second bore for urging said second spool toward said first spool; and a stopper disposed at an end portion of said throttle housing for restricting the range of the sliding movement of said second spool which is caused by the urging force of said coil spring.

3. A flow control apparatus according to claim 2, further comprising an annular chamber formed between said second spool and said stopper and in communication with said discharge passage, the internal pressure of said discharge passage being led into said annular chamber.

4. A flow control apparatus according to claim 3, wherein, when the pressure difference generated across said fixed throttle exceeds the urging force of said coil spring, said second spool begins to slide.

5. A flow control apparatus according to claim 2, further comprising:

an engaging projection disposed on the peripheral wall of one of said throttle housing and said stopper; and an engaging hole disposed on the other of the peripheral walls of said throttle housing and said stopper and engaged with said engaging projection.

6. A flow control apparatus according to claim 5, wherein said engaging hole comprises a guide section which is substantially linear, and a folded blind hole section which is folded to communicate with said guide section, said engaging projection being engaged with said folded blind hole section by the urging force acting on said second spool to attach said stopper to said throttle housing.

7. A flow control apparatus according to claim 1, wherein said throttle housing is fixedly sandwiched between a step portion formed in said valve bore and an end face of said delivering union through an elastic body.

8. A flow control apparatus according to claim 7, wherein said elastic body is a disk spring or O ring.

9. A flow control apparatus according to claim 1, further comprising a supply chamber which is formed between said throttle housing and said first spool and into which a fluid introduced from said discharge passage through said fixed throttle.

10. A flow control apparatus comprising:

a housing;

a cylinder disposed in said housing;

a spool disposed in said cylinder while being urged in one direction along the axial direction of said cylinder, said spool sliding along the axial direction against the urging force to adjust the flow quantity of a fluid;

a stopper disposed in said housing for restricting the range of the sliding movement of said spool toward the urging direction;

an engaging projection disposed on the peripheral wall of one of said housing and said stopper; and an engaging hole disposed on the other of the peripheral wall of said housing and said stopper and engaging with said engaging projection, said engaging hole comprising a substantially linear guide section, and a blind hole section which is folded to communicate with said guide section and with which said engaging projection is engaged, said engaging projection engaging with said engaging hole by the urging force acting on said spool, to attach said stopper to said housing.

11. A flow control apparatus comprising:

a housing;

a cylinder disposed in said housing;

a spool disposed in said cylinder while being urged in one direction along the axial direction of said cylinder, said spool sliding along the axial direction against the urging force to adjust the flow quantity of a fluid;

a stopper disposed in said housing for restricting the range of the sliding movement of said spool toward the urging direction;

a pair of engaging projections disposed on the peripheral wall of said housing and said stopper and separated from each other by substantially 180 degrees, and an engaging hole disposed in the other of the peripheral wall of said housing and said stopper and engaging with at least one of said engaging projections, said at least one engaging projection being engaging with said engaging hole by the urging force acting on said spool, to attach said stopper to said housing.

* * * * *